United States Patent [19]

Pascoe

[11] 4,207,011

[45] Jun. 10, 1980

[54] LINE SPACING AND COLUMN FORMAT CONTROL SYSTEM

[75] Inventor: Robert A. Pascoe, Round Rock, Tex.

[73] Assignee: International Business Machines Corporation, Armonk, N.Y.

[21] Appl. No.: 883,762

[22] Filed: Mar. 6, 1978

[51] Int. Cl.[2] ..... B41J 25/18

[52] U.S. Cl. ..... 400/279; 400/76; 364/200; 364/900

[58] Field of Search ..... 400/61, 62, 63, 64, 400/74, 76, 149, 150, 151, 151.1, 171, 172, 279, 280, 281, 282, 4; 364/200, 900

[56] References Cited

U.S. PATENT DOCUMENTS

| | | | |
|---|---|---|---|
| 3,611,308 | 10/1971 | Grinnell | 400/280 X |
| 3,952,852 | 4/1976 | Greek et al. | 400/279 |
| 4,032,900 | 6/1977 | Kashio | 364/200 |
| 4,086,660 | 4/1978 | McBride | 364/900 |

*Primary Examiner*—Ernest T. Wright, Jr.
*Attorney, Agent, or Firm*—James H. Barksdale, Jr.

[57] ABSTRACT

A system for printing a plurality of sequentially stored text columns in a side-by-side format with the line spacing of one column varying from that of another. Each column is to be printed out in an operator defined location. After a line from one of the columns is printed on a print line in a defined location, the carrier is caused to escape. Any corresponding lines from succeeding columns, as determined by their line spacing requirements, are printed on the same line prior to causing a printer carrier return. That is, the line spacing requirement of a column is utilized to determine whether a line from the column is to be printed on the print line being printed.

12 Claims, 18 Drawing Figures

LINE SPACING AND COLUMN FORMAT CONTROL SYSTEM

DESCRIPTION

CROSS REFERENCE TO RELATED APPLICATIONS

U.S. patent application Ser. No. 884,062, filed 03/06/78, entitled "Font And Column Format Control System", and having R. A. Pascoe as inventor.

U.S. patent application Ser. No. 884,082, filed 03/06/78, entitled "Tabulation Control System", and having R. G. Acosta, M. E. McBride and R. A Pascoe as inventors.

BACKGROUND OF THE INVENTION

1. Field of the Invention

This invention generally relates to printing systems which print out text stored in a buffer. More specifically, this invention relates to a system for controlling the output side-by-side printing of sequentially stored columns having varying line spacing requirements.

2. Description of the Prior Art (Prior Art Statement)

Representative of the closest known prior art are U.S. Pat. No. 3,952,852; the IBM Electronic "Selectric"* Composer; and U.S. patent application Ser. No. 680,562, filed Apr. 27, 1976 having Michael E. McBride as inventor and entitled Automatic Format Control for Text Printing System, now U.S. Pat. No. 4,086,660, issued Apr. 25, 1978.

*Registered Trademark, International Business Machines Corporation.

In U.S. Pat. No. 3,952,852 a system is disclosed having a keyboard and printer, a buffer and control, and a multi-column playout control unit. During setup for input keying, a beginning of memory code is stored in the buffer. Also, since the input printer is the same as the output printer, a tab field is set up for defining the printing locations of the columns. This can be set up by operator keying. For columns which are to be stored sequentially, but printed out in a side-by-side manner, the beginning of each column is defined by keying a column begin code. Along with this code are keyed and stored column mode and measure codes. Following the column begin, mode, and measure codes for each column, the column text is keyed and stored. At the end of the last column to be printed out in side-by-side relationship, a column end code is keyed and stored. Upon playout from the buffer, the thus established buffer memory is scanned when a column begin code is encountered. An operation flag is inserted into the memory after the first column begin code. After each column begin code except the first, a column marker code is inserted and scan continues. Upon detection of the column end code, scanning continues to the beginning of memory. When the operation flag is again detected, following characters and spaces are printed out in the defined mode until a carrier return is detected. If operation is not in the last column, the printer carrier is caused to tab rather than to return to the left margin, and a column advance operation is performed. This causes a column marker code to be written over the operation flag, and a scan of memory. The next detected column marker code is written over with a new operation flag. Playout proceeds as defined above until a carrier return is detected for the last column. The carrier is then caused to return to the left margin. The operations described continue until each column has been printed in its entirety. After printout of all columns, the column marker codes are flushed from memory.

As related to the instant application, also disclosed is the handling of a column having no further text to be printed when printout of a remaining column has not been completed. This is recognized by the system when a column begin or column end code is addressed by the operation flag following a column advance operation.

From the above, the side-by-side printout of sequentially stored text is fully disclosed. Included is the handling of empty columns, but different column indexing requirements are neither contemplated or disclosed.

The IBM Electronic "Selectric" Composer can be used to effect a side-by-side printout of sequentially stored columns. If line spacing is to vary from column to column, or within a column, the operator is required to key extra carrier returns or indexes during input keying and storage. During later playout, the system will recognize the extra index and carrier return codes and print the text out with the proper line spacing.

Based on the above, the IBM Electronic "Selectric" Composer is capable of performing a side-by-side printout of sequentially stored columns with proper line spacing. The problems with the use of this system for this purpose are that it is tedious and time consuming to key additional indexes and carrier returns, and the system is not capable later of adjusting text without removing the stored extra carrier return and index codes.

In the above-referenced McBride patent application, an automatic system is disclosed for controlling format during playout of a job made up of a number of pages recorded on a number of magnetic cards. At the beginning of a job and upon input keying, format information is keyed and stored in a text buffer. The format information is made up of tab set locations, measure length, index values, adjust modes, etc. For format changes prior to recording on a magnetic card, new format information is keyed and stored in the text buffer along with keyed text. Upon recording the text and format information on a card, the format information last in effect is transferred to a format buffer to control format until changed.

This prior art is relevant in that printer indexing (line spacing) requirements are stored and remain in effect from one segment to the next unless changed. One basic difference though, is that in the case of the instant application, the segments are different columns, whereas in the referenced McBride application the segments are different media. In addition to this difference, an important distinction is in the area of storing codes and later control. In the McBride application the codes are stored in a format buffer and remain in effect until different codes are detected in memory. The addition in the instant application is that index codes are system generated and stored in memory to control printing from column to column.

In summary, the above described art is relevant to varying degrees, but falls short of either anticipating or rendering the subject invention obvious. More specifically, the advance of the instant application is in the area of a system structured not only to store format information to control printing of following text, but to update the text buffer to control printing of sequentially stored text columns in a side-by-side format when the columns have different line spacing requirements. The advantages of this advance are reduced operator keying and attention, and automatic system updating of the text memory.

Other art considered relative to this application includes U.S. Pat. Nos. 3,611,308 and 4,032,900. Neither of these patents is considered any more pertinent than the art described above.

SUMMARY OF THE INVENTION

A system is provided having a keyboard and printer, a text and control code buffer, a multi-column playout control, and a line space increment control. During input keying, line space increment codes are keyed and stored along with text codes in the buffer. This is the case for columns which are to be stored sequentially, but printed out in a side-by-side format with varying line spacing requirements among the columns. When columnar playout begins from the buffer, the first detected line space increment code is stored in a line space code store. Following printing of one line of a column, a column advance operation is performed before printing any corresponding line from the next column on the same print line. During this operation, the text and control code memory in the buffer is updated, if necessary, for the current column. A scan operation accompanies the column advance operation, and if the next column has a different line spacing requirement, the line space code store is updated. That is, during input keying, the line space increment for the column being keyed is stored in the memory. This will control upon later printout the number of effective carrier returns or indexes to be executed by the printer. When the line spacing increment is to change, for example, from single to double indexing, another line space increment code is keyed and stored in the text and control code memory. Upon playout from the memory, the memory is scanned and the first line space increment code is stored in the line space code store. Printing then begins from memory for the first line of the first column. When a carrier return is detected, a number of column index codes are written into memory before the second line of the first column. This number will be equal to the line space increment, minus one. The printer is caused to tab rather than carrier return, and a column advance operation is performed. During the scan operation associated with the column advance operation, the operating point (operation flag) is advanced to the beginning of the second column. If a line space increment code is stored for the second column, the line space code store is updated. Following printout of the first line of the second column, the memory is updated. This is accomplished as before with a number of column index codes being stored in memory before the second line of the second column. Operations continue as described for the first line of each column, and then a column advance operation is performed to the first column. The carrier will have been returned to the left margin to begin printing on the second print line. A detected column index code will result in deletion of the column index code, carrier escapement, and a column advance operation to begin printing the next column. Thus, there is in effect a multiple indexing operation when a column index code is detected in memory.

DESCRIPTION OF THE PREFERRED EMBODIMENT

Figure 1:
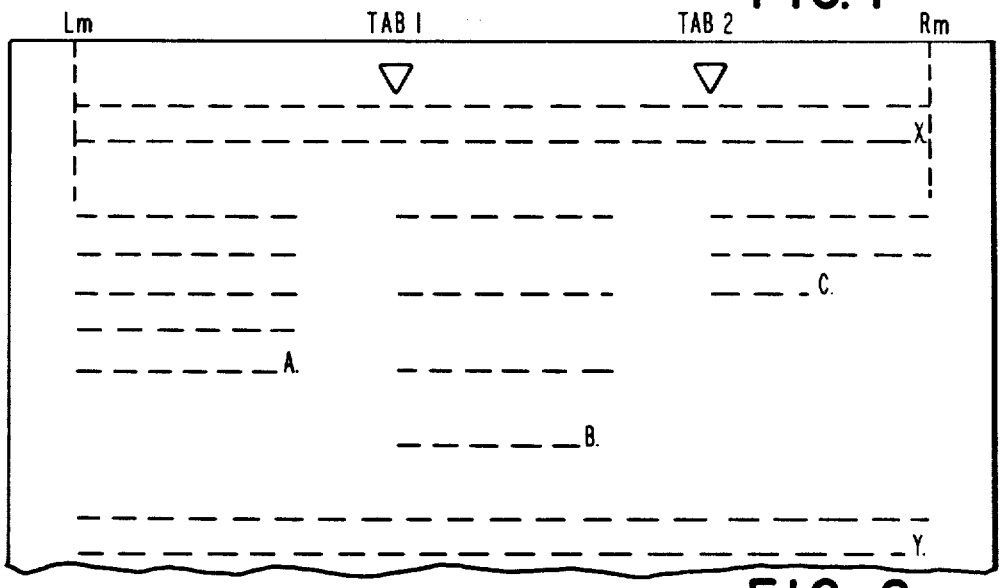
FIG. 1 illustrates a desired output format including columns of text aligned side-by-side with varying line spacing.

For a more detailed description of the invention, reference will first be made to those figures of the drawing which illustrate the operations to be performed in terms of both memory arrangement and printout. Referring first to FIG. 1, there is shown a desired output format. The left and right margins Lm and Rm have been set as well as two tab positions, TAB 1 and TAB 2. The first two lines as well as the last two lines are shown justified between the left and right margins Lm and Rm. Intermediate these two sets of lines are three columns of varying length and having varying line spacing. That is, the left or first column contains five single spaced lines with the left margin for the entire sheet also serving as the left margin for the column. The center or second column contains four double spaced lines with the left margin being the TAB 1 position. The right or third column contains three single spaced lines. The left margin for the third column is the TAB 2 position.

The dashes represent characters and spaces. X and Y represent the last characters of the above referred to two sets of lines. A, B, and C represent the last characters in each of the columns.

Figure 2:
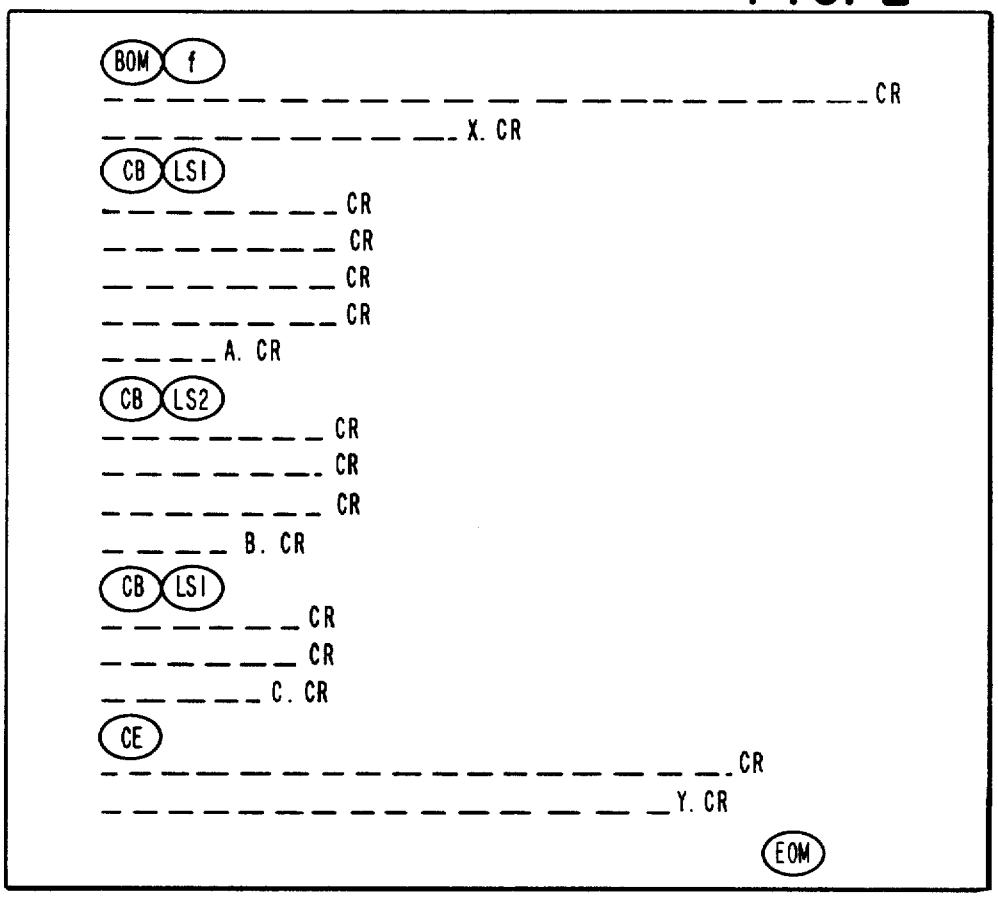
FIG. 2 is a pictorial representation of a text and control code memory arrangement used as a basis to obtain the desired format shown in FIG. 1 upon playout.

Refer next to FIG. 2. In this figure there is shown a memory arrangement including character and control codes corresponding to an operator input keying sequence. This arrangement is only representative of a serial format which will be stored in the buffer upon input keying. That is, there will be a serial stream of text and control codes which will make up a text and control code memory. It is to be pointed out that printing will occur during input keying, but will not exactly correspond to the pictorial representation of the memory shown in FIG. 2. This is because the beginning of memory (BOM), flag (f), column begin (CB), column end (CE), line spacing increment (LSX), carrier return (CR), and end of memory (EOM) codes making up the memory will not be printed. Also, since the same input-/output device is used for input keying, printing, and storage, as is used for output printing (playout), the operator will set the left and right margins Lm and Rm and the tab positions (TABX) as shown in FIG. 1.

The buffer referred to above is a page buffer. The beginning of the stored page is marked by a beginning of memory (BOM) code and the end of the page is marked by an end of memory (EOM) code. During input keying, the operator can key these codes or they can be input into the buffer by the system. The mode of entering these codes is considered to be no part of this invention.

The flag (or alternatively, operation flag) code (f) shown following the beginning of memory (BOM) code is the operating point and will be addressing the next character or control code in memory to be acted upon at any particular time. The flag (f) code is a system generated and controlled code. The operator will begin keying text from the left margin Lm and when the right margin Rm is approached and an acceptable line ending is reached, a carrier return (CR) will be keyed. The text and carrier return will be stored in memory and the printer carrier will be returned to the left margin Lm. The platen of the printer will then be indexed and the second line will be keyed, followed by a carrier return. As pictorially represented in FIG. 2, following the first two lines, three columns have been keyed and stored. At the beginning of keying of the first column, the operator will key a column begin (CB) code, followed by a line space increment (LSX) code. For this column, the line space increment X is one, representing single indexing. During later playout from memory, this line space increment code will be in effect and control operation until a different line space increment code is encountered. Although shown following the column begin code, the line space increment code could have been keyed and positioned at the beginning of any line following the beginning of memory. Also, a line space increment code need not be located in, or at beginning, of each column since the code in effect in the previous column will remain in effect until a different line space increment code is encountered. As shown, the text for the first column follows the line space increment code LSI. Since the second column is to have a different line spacing, a line space increment code (LS2) is keyed following the column begin code. In this case, there is to be double indexing. The LS2 code is followed by text.

As shown in FIG. 1, the third column has a single indexing requirement and an LS1 line space increment code is keyed during input keying following the column begin code for the third column. This is followed by text. Then, since there are no more columns and the last two lines are to be printed between the left and right margins, a column end (CE) code is keyed and stored. The line spacing requirement for the last column is the same for the final paragraph (last two lines), and therefore, a new line space increment code need not be keyed. Simply keying the text for the last two lines is called for. An end of memory (EOM) code is then stored by either the system or operator keying.

Figure 3:
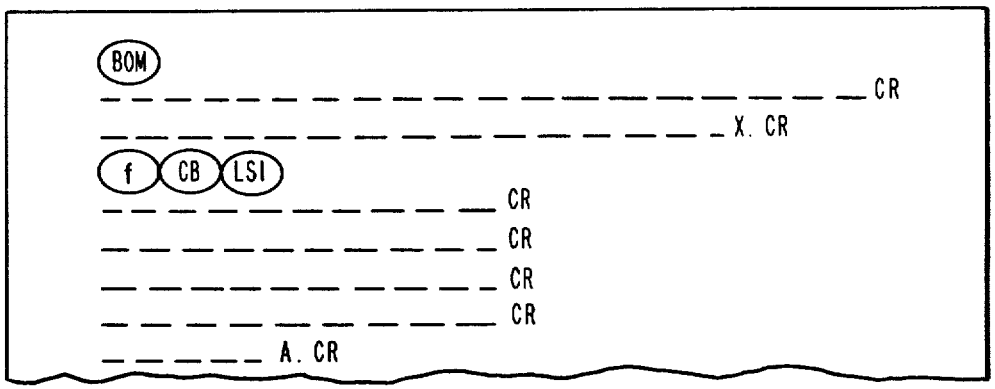
FIG. 3 is a pictorial representation of the memory prior to a beginning of playout of the first of the columns depicted.
Figure 4:
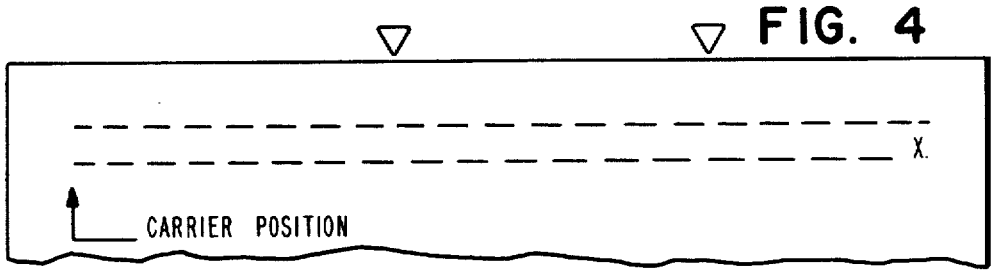
FIG. 4 illustrates a printout of the first two lines from the memory in FIG. 3, and the printer carrier position prior to printout of the first column.

Refer next to FIG. 3. This figure is a pictorial representation of the memory organization prior to the beginning of playout of the first column. The flag (f) is addressing the first column begin code which defines the beginning of the first column. At this time, the carrier will be positioned at the left margin with the first two lines already having been printed as illustrated in FIG. 4. FIG. 4 is a pictorial representation of the printed page printed from the memory illustrated in FIG. 3 up to the beginning of the first column.

The term playout as used herein is meant to include any operation of the system such as actual printout of text from the memory as well as any column advance and scan operation as hereinafter described. The term printout includes the actual printing of characters from memory following any positioning, advancing, and scanning operation between columns. A column advance operation is the advancing of the flag from one line in one column to a corresponding line in a subsequent column. a scan operation involves the detection of codes in memory during a column advance operation.

Figure 5:
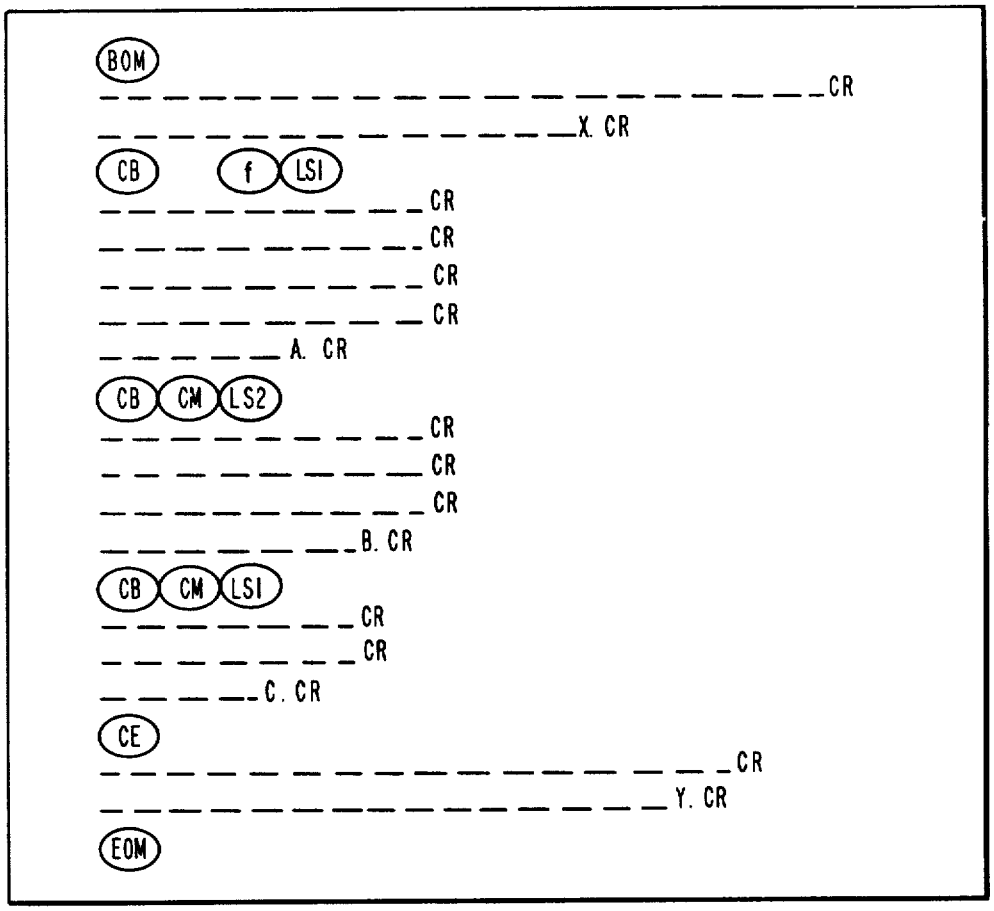
FIG. 5 is a pictorial representation of the memory prior to playout of the first column of text.

With the memory corresponding to FIG. 3 and the printed page and carrier position corresponding to that illustrated in FIG. 4, a preliminary scan operation is performed and column marker (CM) codes are inserted into the memory following each column begin code except the first. This preliminary scan is a complete column scan as opposed to a between column scan associated with a column advance operation as referred to above. The flag (f) is then advanced past the first column begin (CB) code. This is illustrated in FIG. 5 with the flag (f) addressing a line space increment (LS1) code which defines the indexing mode for the first column. Therefore, FIG. 5 is a pictorial representation of the memory arrangement with the carrier positioned at the left margin and ready for printing the first column. Column marker codes have been inserted following the column begin codes other than the first.

Figure 6:
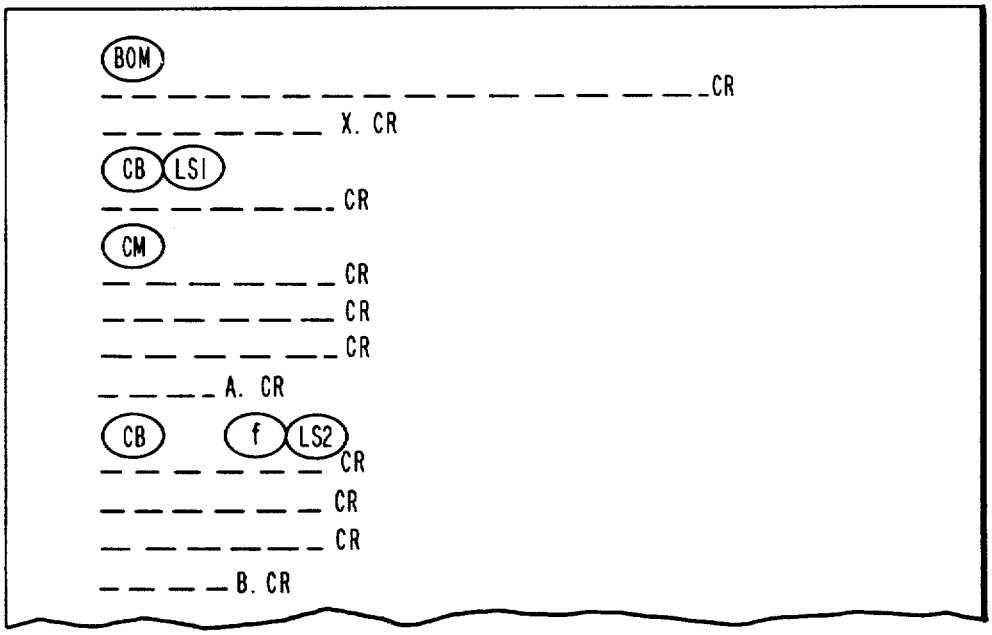
FIG. 6 is a pictorial representation of the memory after playout of the first line of the first column of text.

Referring next to FIG. 6 there is shown a pictorial representation of the memory arrangement following playout, including printing, of the first line of the first column. A column marker (CM) code has been written over the flag (f) at the end of the first line and beginning of the second line of the first column. This occurred during column advance and scan operations performed between columns. The next column marker code has been written over with a new flag (f) to define the beginning of the printout operation for the first line of the second column. Before the column advance operation was performed, the line space increment code in effect was LS1, denoting single indexing. As will be hereinafter explained in greater detail, column index codes are inserted into the current column in memory on the basis of the last line space increment in effect, minus one. In this case, the line space increment for the first column is LS1, and LS(1-1) is equal to LS0. Therefore, no column index code is written or inserted into memory. Printout will now proceed for the first line of the second column.

After printout of the first line of the first column, the carrier will be escaped through a tabbing operation upon detection of the carrier return code, and will be positioned at the TAB 1 position.

Figure 7:
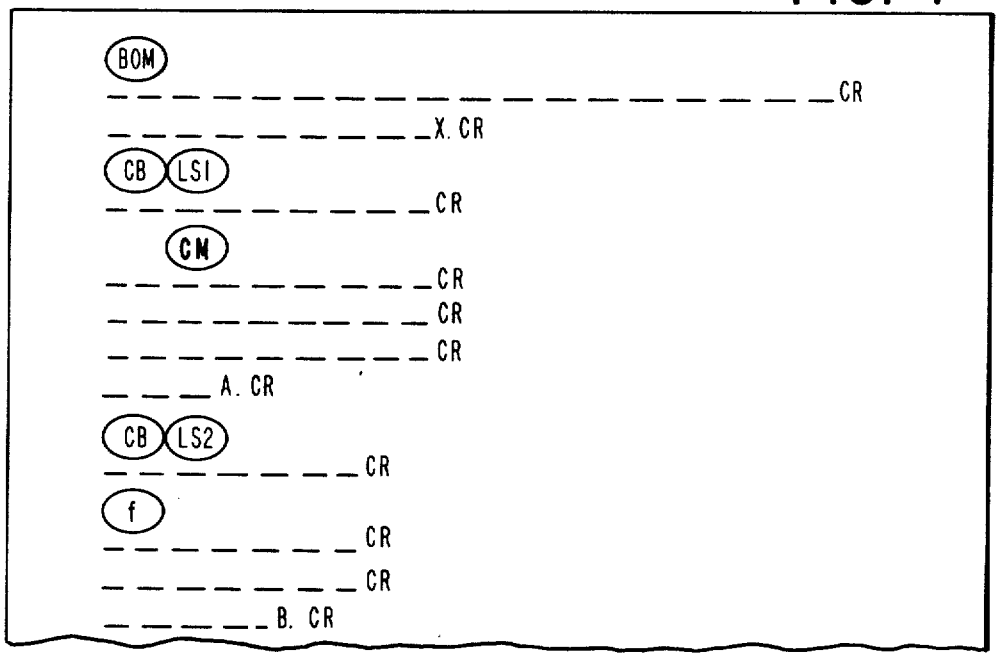
FIG. 7 is a pictorial representation of the memory after playout of the first line of the second column.
Figure 8:
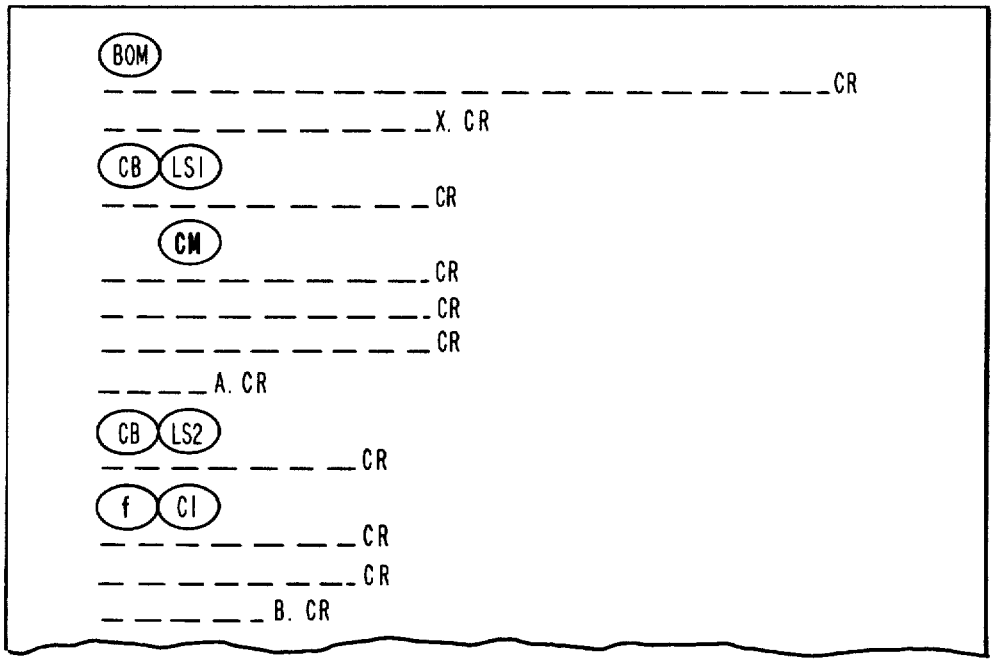
FIG. 8 is a pictorial reprsentation of the memory following updating of the memory after playout of the first line of the second column.
Figure 9:
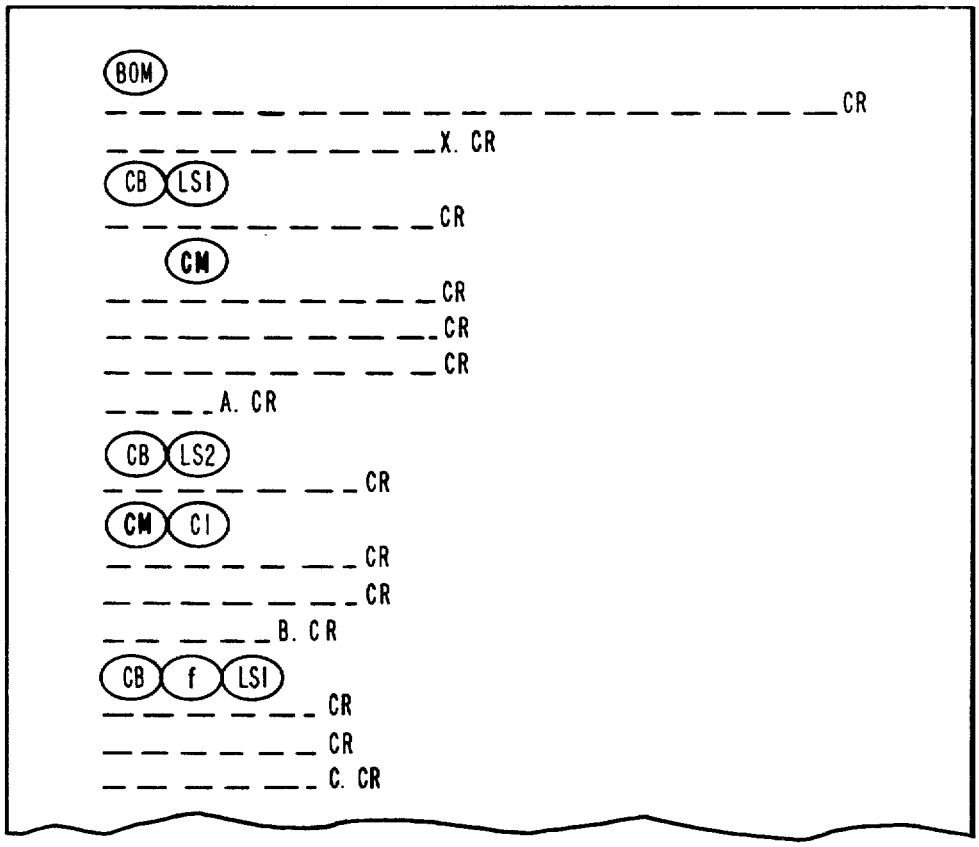
FIG. 9 is a pictorial representation of the memory prior to playout of the first line of the third column.

FIG. 7 illustrates the memory arrangement following the playout of the first line of the second column. The line spacing requirement LS2 for the second column is for double indexing. As explained above, the basis for inserting column index codes into memory is the line spacing increment last in effect, minus one. For the second column, LS(2-1) is equal to LS1, and one column index (C1) code is inserted into memory at the beginning of the second line of the second column. This is illustrated in FIG. 8. A column advance to the first line of the third column now takes place and the column marker (CM) code therein is replaced with a new flag (f). The previous flag (f) is replaced with a column marker (CM) code. This is illustrated in FIG. 9. A column advance operation is now performed and the carrier is escaped to the TAB 2 position. Printout will now be for the first line of the third column.

Figure 10:
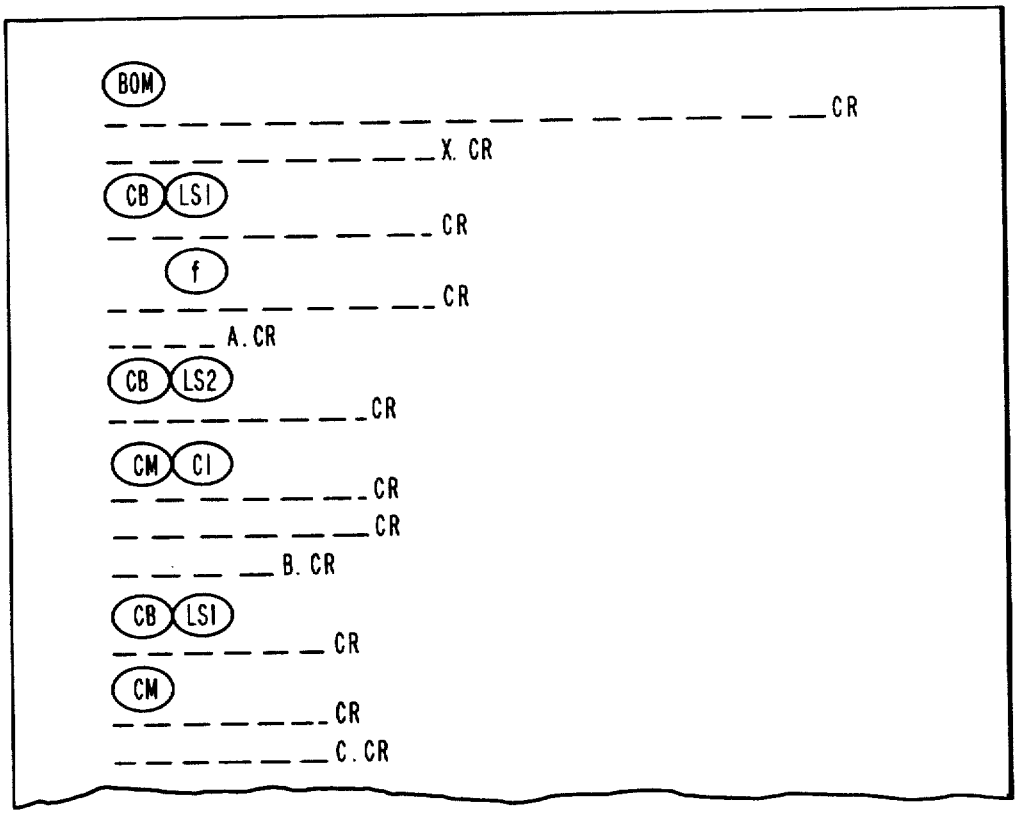
FIG. 10 is a pictorial representation of the memory prior to playout of the second line of the first column.

Following printout of the first line of the last column, the flag (f) will follow the carrier return (CR) for this line and a column marker (CM) code is substituted therefore. The flag (f) is then effectively advanced to the beginning of the second line of the first column and substituted for the column marker (CM) code. In actuality, a column marker (CM) code is written over the flag (f) and a new flag (f) is written over the next column marker (CM) which is at the beginning of the second line of the first column. FIG. 10 is an illustration of the memory arrangement or organization following the printout of the first line of the last column and a column advance operation to the second line of the first column. The carrier will be positioned at the left margin Lm for the page.

Figure 11:
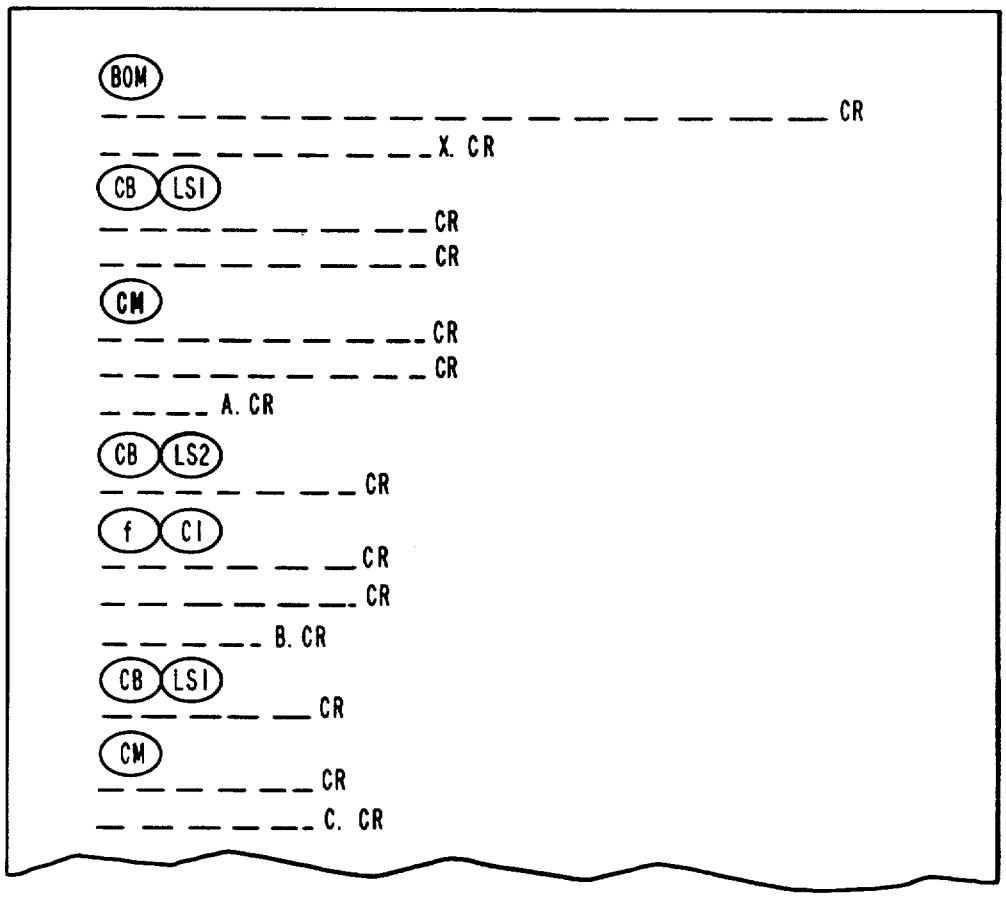
FIG. 11 is a pictorial representation of the memory following playout of the second line of the first column.
Figure 12:
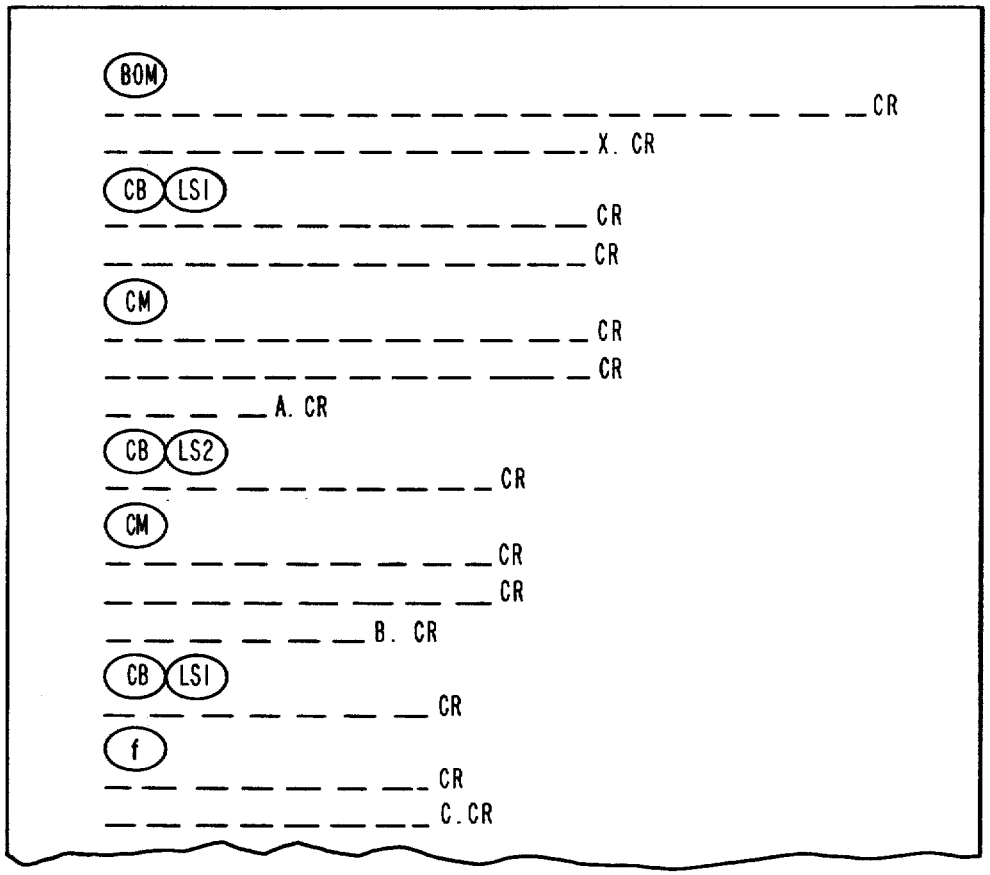
FIG. 12 is a pictorial representation of the memory prior to playout of the second line of the third column.
Figure 13:
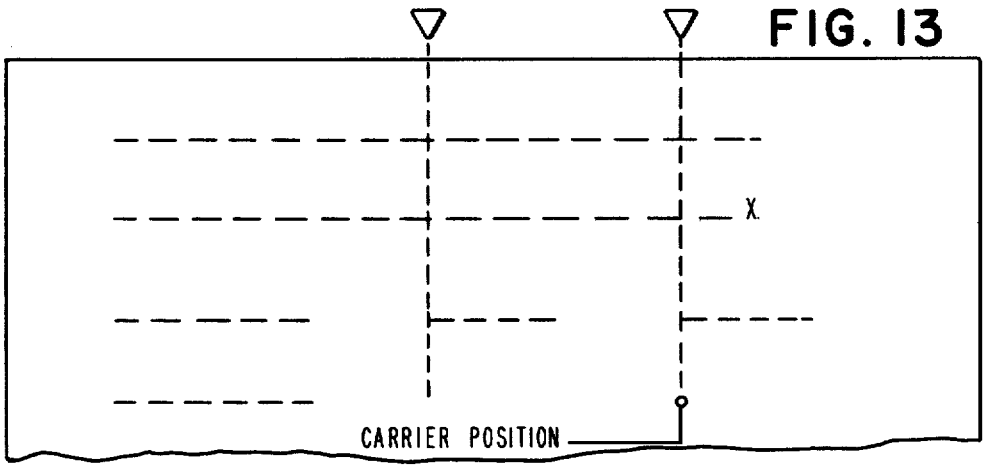
FIG. 13 represents the printed page and carrier position prior to playout of the second line of the third column.

Refer next to FIG. 11. This figure illustrates the memory arrangement following the printout of the second line of the first column. A column advance operation has been performed wherein the flag (f) has effectively been advanced to the second line of the second column. A column marker (CM) code has been written over the previous flag (f). A column index (CI) code was not written into memory at the beginning of the third line of the first column since the line space increment requirement for the first column is one (LS1). The carrier position is now the TAB 1 position. The first code encountered when printout begins for the second line of the second column is a column index (CI) code. The result of this is the deletion of the column index (CI) code, and another column advance operation to the second line of the third column. The memory will then be arranged as shown in FIG. 12, and carrier position and printed page will be as depicted in FIG. 13. These events simulate the event where there is no second line in the second column. There has effectively been a double indexing in the second column.

Had the line space increment requirement for the second column been for triple indexing rather than double indexing, two column index (CI) codes would have been inserted into memory. When encountered, only the first would be deleted. Later, during playout on the third line involving the second column, the second column index code would be deleted, and a column advance operation would be performed to the third line of the third column.

In the above examples, text is to be printed on the first line of each column. If the first line of one of the columns were not to contain text, the operator would simply key a carrier return along with properly located line space increment (LSX) codes during input keying for storage in memory. During playout, this would result in tabbing and column advance operations to the corresponding line of the next column.

An important point to note is that inherent in any carrier return operation is a platen index operation. This is the reason for subtracting one from the line space increment last in effect following printout of a line of a column to determine the number of column index (CI) codes to be written into memory for subsequent lines of the same column.

Figure 15:
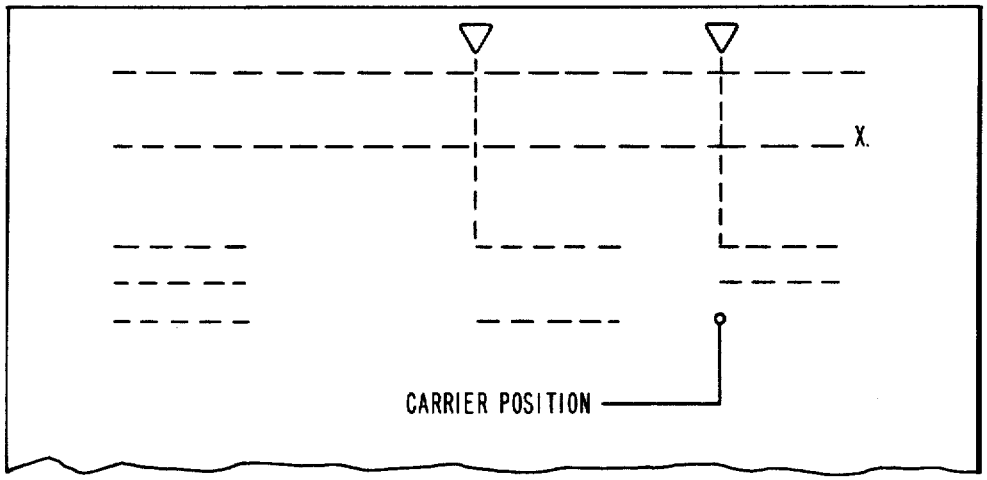
FIG. 15 illustrates the printed page and carrier position prior to playout of the third line of the third column on the third print line.
Figure 14:
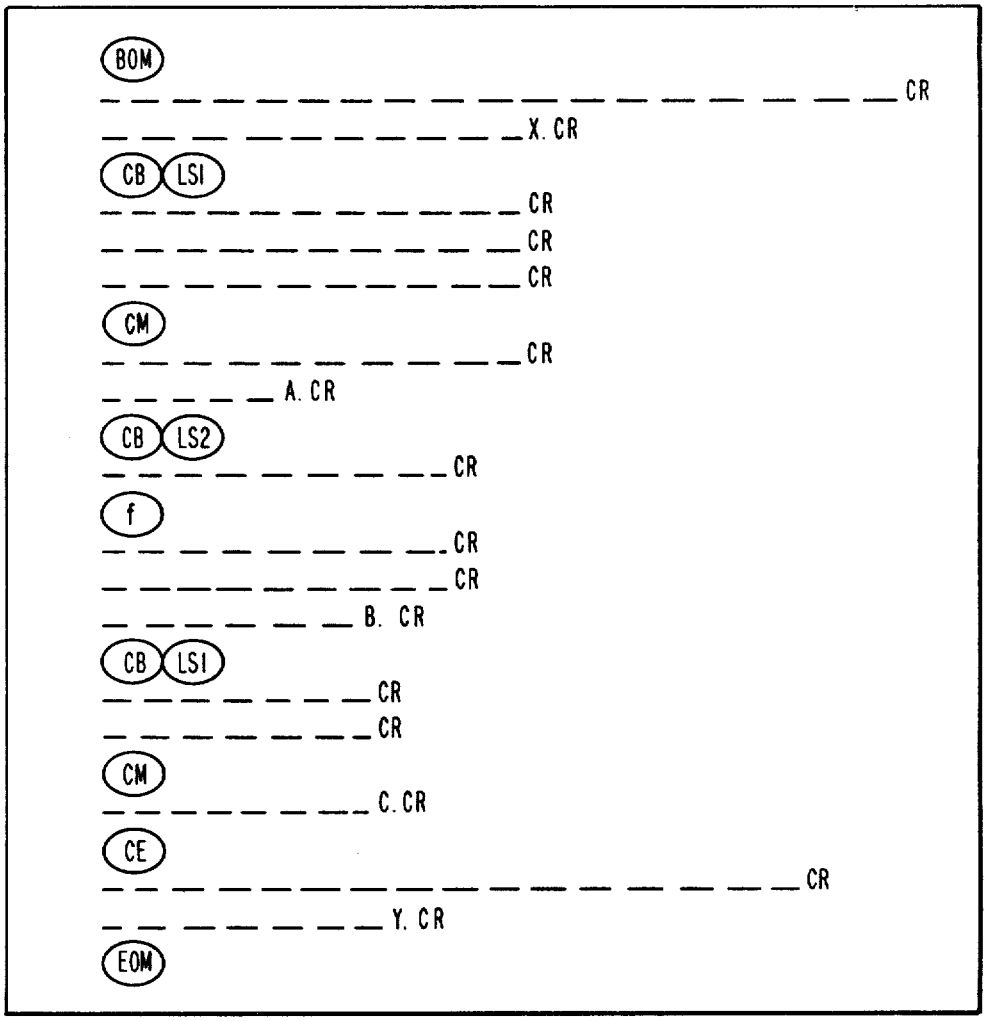
FIG. 14 is a pictorial representation of the memory prior to playout of the second stored line of the second column on the third column print line.

After printout of the second line of the third column, playout continues to the end of the third line of the first column. This is since no column index (CI) code is encountered in between. Both the first and third columns have a single line space increment requirement. When printout later resumes in the second column, a column index code is not encountered. This is because it was deleted earlier. Refer to FIG. 14 for a memory image before the playout of the second line of the second column on the third print line. When the carrier return (CR) for this line is reached, another column index (CI) code is written into memory for the reason explained above. Thus, the next time this column is ready to be printed out, the flag (f) will be addressing a column index (CI) code, which when detected is to be removed. Then a column advance operation is performed simulating the absence of a line in the second column. The carrier will be positioned as is shown in FIG. 15 following playout of the second line of the second column on the third print line. The process of inserting and removing (deleting) column index (CI) codes, and performing a column advance operation without printing out when a column index (CI) code is encountered, continues until all lines from all columns have been played out. Thereafter, a printer carrier return is performed, all column marker (CM) codes are deleted from memory, the flag (f) is advanced beyond the column end (CE) code, and playout continues with the paragraph following the columnar text.

In summary, a number of system generated column index (CI) codes are automatically written into memory for subsequent lines of the same column if the active line space increment (LSX), minus one, is greater than zero. Later, when a column index (CI) code is detected or encountered following a column advance operation, it is deleted, and another column advance operation is performed. The result is an effective printer platen indexing operation.

DESCRIPTION OF SYSTEM STRUCTURE

Figure 16:
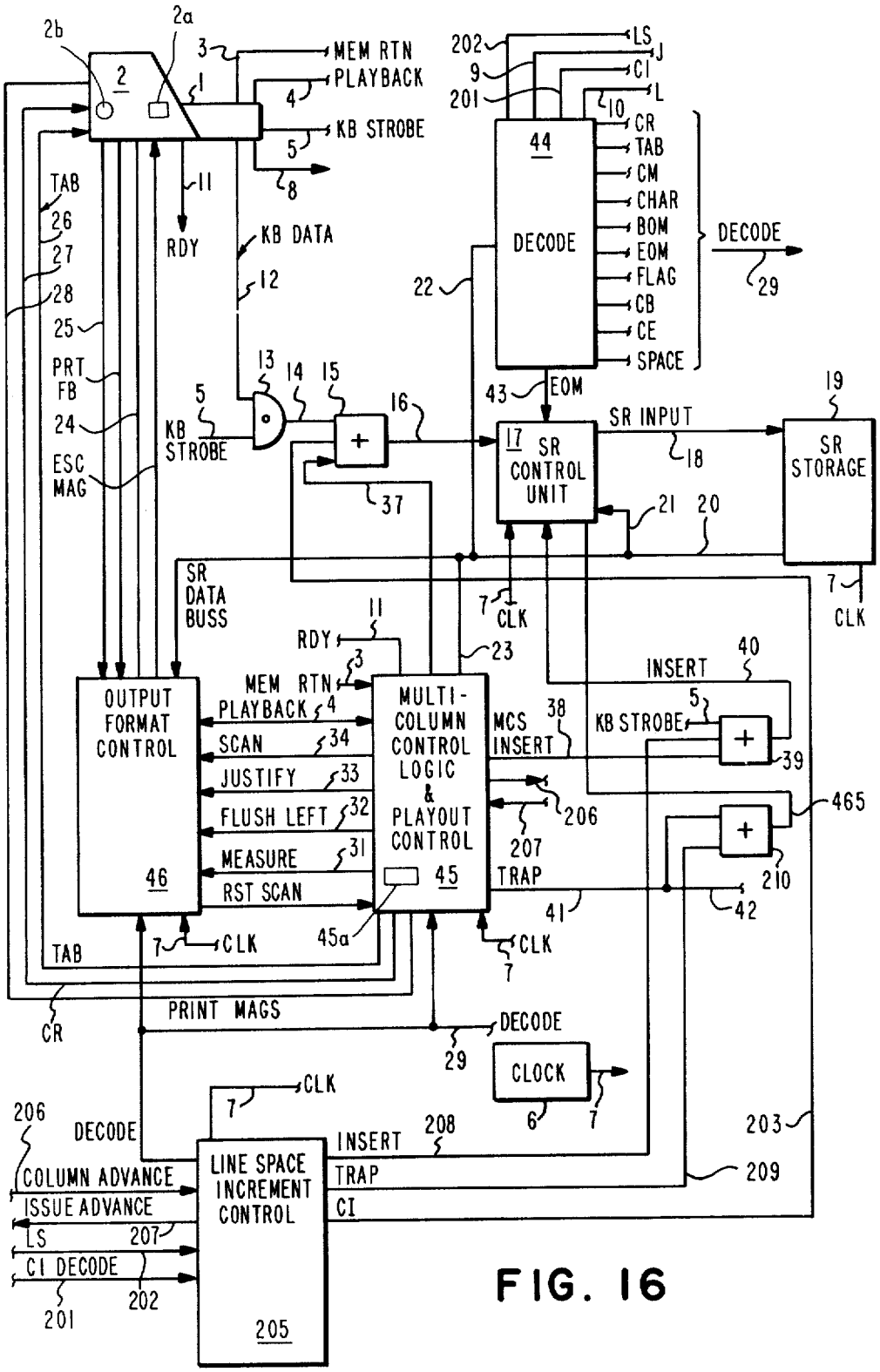
FIG. 16 is an overall block diagram illustrating the structure according to this invention for accomplishing the side-by-side printout of columns having varying line spacing requirements.

Referring next to FIG. 16 there is shown a keyboard 1 and a printer 2. The printer 2 has a carrier **2*a* and a platen 2*b* with one being movable relative to the other. Outputs of keyboard 1 are along a memory return line 3, a playback line 4, a keyboard strobe line 5, and a keyboard data line 12. An output along keyboard strobe line 5 is a timing signal indicating the presence of data (character or control code) on keyboard data line 12. Although line 12** has been represented as a single line, it is to be appreciated that it is representative of as many lines as are required for carrying bits making up a character or control code byte. This is also the case for other lines which are to carry data as opposed to signals where only one line is required. Data which is keyed on keyboard 1 and appears on data line 12 is applied to AND gate 13. Upon the occurrence of keyboard strobe signal along line 5, the data is gated through AND gate 13 and along line 14 to OR gate 15. The data is then output along line 16 to shift register control unit 17. Data input to shift register control unit 17 along line 16 is then output along shift register input line 18 to shift register 19 for storage. Shift register 19 is the page buffer referred to earlier for storing text (characters and spaces) and control codes, and serves as a text and control code memory when loaded. Further details of shift register 19 and shift register control unit 17 will be presented later herein.

Synchronization of the system of shift register control unit 17, shift register 19, output format control 46, multi-column control logic and playout control 45, and line space increment control 205 is provided by the output of clock 6 along line 7. The data input into the shift register 19 along line 18 circulates out of shift register 19 back into the shift register control unit 17 along shift register data buss 20 and 21. The data along line applied along the shift register data buss 20 is also applied along line 23 to multi-column control logic and playout control 45 and along line 22 to decode 44. The data appearing on the shift register data buss 20 is also applied to the output format control 46. It is to be appreciated that as far as the input to the shift register 19 is concerned, all inputs are considered data. This will include the line space increment codes, as well as other control codes, and text codes. The outputs of decode 44 are a column index (CI) code signal on line 201, a line space increment (LS) code signal on line 202, and other character and control code signals along decode line 29. When justification and flush left text are considered, signals representative of these modes are applied along lines 9 and 10, respectively, when corresponding codes are decoded. For example, if a flag code is defined by all one's, the signal output "flag" along line 29 will come up when the signals along line 22 from the shift register data buss 20 are all one's. Although only one LS line 202 is shown output connected to decode 44 and input connected to line space increment control 205, there are in actuality as many lines as there are index setting capabilities in the system. For some systems, double indexing is a maximum and in this case there would be two LS lines. The line space increment control 205 inputs data (column index codes) to shift register control 17 along line 203. Column advance and issue advance control signals are applied along lines 206 and 207, respectively, between line space increment control 205 and multi-column control logic and playout control 45. These signals are used to synchronize logic and control 45 and control 205, and indicate when column index codes are to be inserted into shift register 19. The line space increment control 205 includes a random access memory 402 (FIG. 18) which is used for storing the currently active line space increment. This is the line space code store referred to earlier. A more detailed discussion will follow when reference is made to FIG. 18.

Printer 2 has a ready output along line 11 which comes up when, for example, the printer 2 is idle and ready for printing a character. This signal is applied to multi-column control logic and playout control 45. Logic and control 45 has output lines such as line 28 connected to print magnets of printer 2. Other outputs from logic and control 45 include a carrier return line 27 for causing the printer 2 to perform a carrier return operation and a tab line 26 for causing the printer 2 to escape.

SHIFT REGISTER CONTROL AND SHIFT REGISTER

Figure 17:
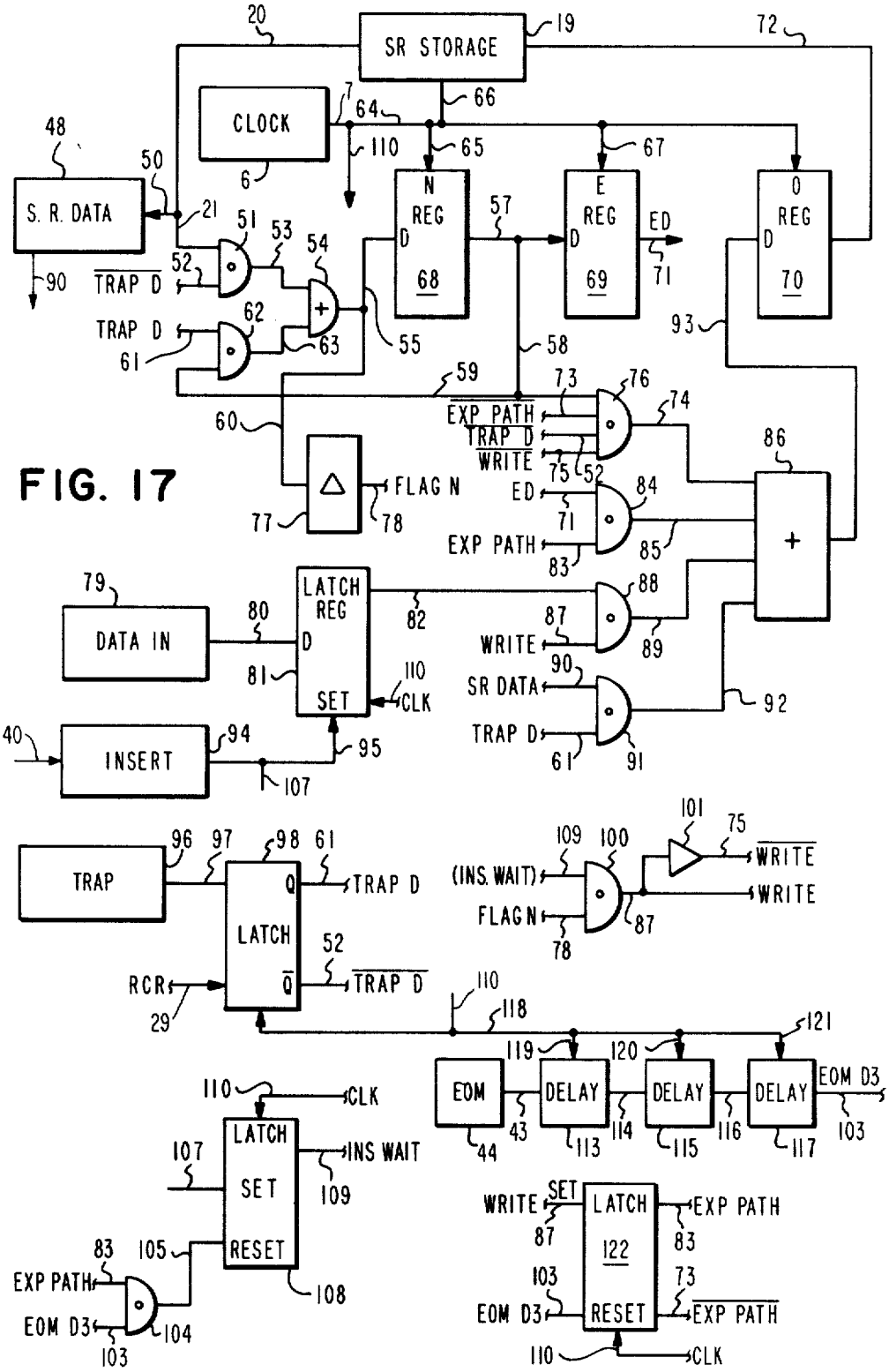
FIG. 17 illustrates in greater detail the shift register storage and control shown in FIG. 16.

Refer next to FIG. 17. The functions of the shift register control 17 and shift register 19 subsystem are to store data, insert data into, rearrange data within, delete data from, write data over existing data, and recirculate data. The system clock 6 shown in FIG. 16 controls the timing of these data manipulations, and is shown again in FIG. 17. More specifically, the output of clock 6 and input to the shift register 19 along line 7 is along lines 64 and 66. The output of clock 6 along line 7 is also to N register 68 along lines 64 and 65, to E register 69 along lines 64 and 67, and to O register 70 along line 64. All data transfers occur on the clock signal. The normal mode of operation for the subsystem made up of the shift register 19 and shift register control 17 is for data to circulate out of shift register 19 along the shift register data buss 20 and along line 21. This data is input to AND gate 51 included in shift register control unit 17. Since the signal NOT trap D is normally up, the data on the shift register data buss 20 will be gated through AND gate 51 and along line 53 to OR gate 54. The output of OR gate 54 is along line 55 to the N register 68. The NOT trap D input to AND gate 51 is along line 52. Characters appearing at the output of latch register (N register) 68 normally shift along lines 57 and 58 to AND gate 76. This data is gated through AND gate 76 and along line 74 to OR gate 86. This is since the signals NOT expand path along line 73, NOT trap D along line 52, and NOT write along line 75 are normally up. The output of data from OR gate 86 is along line 93 to latch register 70. The letters N in register 68, E in register 69 and O in register 70 denote normal, expand, and output, respectively. The output of the output register 70 is along line 72 back into the shift register 19. The path thus described is termed the normal path. It is to be noted that characters appearing at the output of the normal register 68 are also shifted into the expand register 69 along line 57 in all cases. However, the data in the expand register 69 is not normally used.

When a character is to be inserted into shift register 19, it is applied along a data buss represented by line 80 to latch register 81. The data in block 79 represents a data source which can be from keyboard 1 in FIG. 16. At this time, an external insert signal 94 is applied along set line 95 to latch register 81. The insert signal 94 can be obtained from an external source or from line 40 in FIG. 16. With latch register 81 set, the data impressed upon the data buss 80 is gated into latch register 81. The insert signal 94 is also applied along set line 107 to latch register 108. When latch register 108 is set, an output is applied along insert wait line 109. Latch register 108 is clock controlled along line 110 from clock 6. At this time, data will be shifting along the normal data path described above and the data to be inserted will be loaded into latch register 81. For a character to be inserted into memory following the operation flag (f), characters in the shift register 19 continue to shift along the normal data path until the operation flag (f) appears in the normal register 68. The operation flag (f) being shifted along line 55 into register 68 is also shifted along line 60 into a decode 77. Therefore, at the time that the flag (f) is inserted into register 68, it is decoded by decode 77 and a flag N output is applied along line 78. The flag N signal appearing on line 78 is applied to AND gate 100. Since the other input to AND gate 100 is the insert wait signal applied along line 109, the conditions are met for gating a signal along a write line 87. The write signal applied along line 87 is also applied to AND gate 88. This will permit the contents of latch register 81 to be applied along line 82 and gated through AND gate 88. The output of AND gate 88 is along line 89, through OR gate 86, and along line 93 to the output register 70. The write signal applied along line 87 is also applied to inverter 101, and an inverted write signal is applied along line 75. Therefore, a NOT write signal is applied along line 75. The NOT write signal appearing on line 75 is also applied to AND gate 76 to inhibit the gating of the flag (f) through OR gate 86.

At this time the character which is desired to be inserted into the normal data path and data flow is gated from latch register 81, through AND gate 88, through OR gate 86 and into the output register 70. The operation flag is inhibited at AND gate 76. But, each character input to the normal register 68 is also input into the expand register 69. Therefore, the flag (f) is input along line 57 to the expand register 69.

At the time that the operation flag (f) is stored in the expand register 69, the write signal is applied along the set line 87 to latch 122. When latch 122 is set, an expand path signal is applied along line 83. On the same clock pulse that the data character is gated into the output register 70, the operation flag (f) is gated into the expand register 69. This is when the expand latch 122 is set. Thereafter, the operation flag (f) appearing at the output of the expand register 69 is applied along line 71 to AND gate 84. With the expand path signal along line 83 being up, the operation flag (f) from the expand register 69 is gated through AND gate 84 and along line 85 to OR gate 86. From OR gate 86 the operation flag (f) is gated along line 93 to the output register 70. A NOT expand path signal is applied along line 73 from latch 122 upon the resetting of latch 122. This is applied to AND gate 76 to inhibit the gating of characters along lines 74 and 93 from the normal register 68 to the output register 70. As long as a positive signal appears on the expand path line 83, the flow of characters is from the shift register 19 to the normal register 68, to the expand register 69, to AND gate 84, and to the output register 70. This data path remains active until an end-of-memory (EOM) code is decoded by decode 44 in FIG. 16. When an end-of-memory (EOM) code appears on the shift register data buss 20, a signal is output along line 43 in FIG. 16 to shift register control unit 17. Decode 44 is illustrated again in FIG. 17. The end-of-memory code is applied along line 43 to delay or shift register 113 included in shift register control unit 17. The output of delay 113 is along line 114 to delay or shift register 115. The output of delay 115 is along line 116 to delay or shift register 117. The output of delay 117 is an EOM D3 signal applied along line 103. This signal represents the end of memory delayed three bit times. Registers 98, 113, 115, and 117 are controlled by clock 6 along lines 110, 118, 119, 120, and 121. After a delay of three bit times, the end-of-memory (EOM) code will be in the output register 70. The EOM D3 signal is applied along with the expand path signal along lines 103 and 83 to AND gate 104. The output of AND gate 104 is along the reset line 105 to latch 108. The EOM D3 signal along line 103 is also applied along the reset line to latch 122. When latch 122 has been reset, a NOT expand path signal is applied along line 73. This causes restoration of the normal data path.

Another operation in addition to the insert operation above described will be labeled "trap". The trap function or operation is to permit the rearrangement of characters within the shift register 19. An example of an operation where the trap function would be useful would be a paragraph advance operation. With characters shifting along the normal data path and a paragraph advance operation being in order, the operator will key such an operation on keyboard 1. A trap signal represented by block 96 will be applied along line 97. Since an object is to move the flag (f) in memory from its present position to the beginning of the next column paragraph, the contents of the shift register data buss 20 are decoded until the flag (f) is decoded by decode 44 in FIG. 16. The output of decode 44 along line 29 results in the trap signal along line 97. With the trap signal appearing along the set line to latch 98, an output is applied along line 61; being a trap D signal. During the clock time when the trap D signal comes up, the flag (f) is gated into the normal register 68. At this time, the trap D signal is applied along line 61 to AND gate 62. The other input to AND gate 62 is the output of the normal register 68 along lines 57, 58, and 59. The output of AND gate 62 is along line 63 to OR gate 54. Another output of latch or shift register 98 is a NOT trap D signal applied along line 52. This is applied to AND gate 51. As long as the trap D signal is up, the data appearing in the normal register 68 is gated back into the input, maintaining the operation flag (f) trapped in the normal register 68. The trap D signal along line 61 is also applied to the input of AND gate 91. The other input to AND gate 91 is shift register data applied along line 90. This is derived from data buss 20, line 50, and shift register data block 48. From block 48 the shift register data is applied along line 90 to AND gate 91. Data appearing at the output of shift register 19 is thereby gated through AND gate 91, along line 92, through OR gate 86, and along line 93 to output register 70. The above-described conditions will be maintained as long as the trap output of register 98 remains up along line 61. This signal along line 61 is to remain up until a double or required carrier return, etc., code denoting the end of a paragraph is decoded by decode 44 and an output is applied along line 29. Upon decode of a required carrier return code, a signal is applied along line 29 to reset latch register 98. The output of latch register 98 will then be along the NOT trap D line 52 one bit time later. At this time, the carrier return code has already been clocked into the output register 70 and the normal data path has been restored. On the next clock time the flag (f), which is being held in the normal register 68, will be gated into the output register 70 following the carrier return (CR) code. The character following the carrier return code will be gated through AND gate 51, OR gate 54, and into the normal register 68.

Referring again to FIG. 16, it is to be assumed that the shift register 19 has already been loaded with a beginning of memory (BOM) code and followed in order by an operation flag (f), and an end-of-memory (EOM) code. Upon the keying of data by the operator, the data is stored in the shift register 19 through an insert operation as above described. The keyboard data appears on line 12, and for each character keyed, a keyboard strobe signal is applied along line 5. This causes the data appearing on the data buss 12 to be gated through AND gate 13 and along line 14 to OR gate 15.

The keyboard strobe signal applied along line 5 is also applied to OR gate 39. The output of OR gate 39 is an insert signal applied along line 40 to the shift register control unit 17. Each character keyed is therefore inserted into the memory between the beginning of memory (BOM) code and the end-of-memory (EOM) code.

For playout of stored text, the operator will depress a memory return button and a signal will be applied along line 3 from keyboard 1. This signal is also applied to multi-column control logic and playout control 45. The trap signal represented by block 96 in FIG. 17 is output by logic and control 45 along lines 41 and 42. This can be for repositioning the flag (f) code immediately after the beginning of memory (BOM) code for a playout operation. Thereafter, the operator will depress a playout button on keyboard 1 and a playback signal will be applied along line 4 from keyboard 1. This signal is applied to both logic and control 45 and output format control 46. When the flag (f) appears on shift register data buss 20 and line 22, and is applied to decode 44, the trap signal is brought up for one bit time. This causes the advancing of the flag (f) one position in memory. Also, logic and control 45 will gate the data (character) on the shift register data buss 20 into an internal storage register **45*a* on the bit time following the occurrence of the flag (f) code on the shift register buss 20. When the ready condition is received along line 11 from printer 2, a character will be printed due to the signal applied along the print magnet line 28 to printer 2. The character following the operation flag (f) will be the one printed. The above operation is repeated for each character with the operation flag (f) being advanced toward the end of memory. When a space is detected in the data flow, the flag (f) is advanced in the normal manner. However, output format control 46 will output a space to printer 2 along line 24. Escapement for a space will be controlled dependent upon a count of emitter (escapement) pulses applied from printer 2 to output format control 46 along line 25. Output format control 46 is structured to control the output format. It receives mode commands from logic 45 such as scan along line 34. Further, it continuously monitors the shift register data buss 20 and decode signals from decode 44. Output format control 46 further has the capability to scan the data appearing on the shift register data buss 20. It is therefore the function of control 46 to continuously monitor output and provide the correct value for any space outputted according to the mode supplied by logic and control 45**.

Other lines 31, 32, 33, 37 and 38 illustrated in FIG. 16 are identically numbered and described in U.S. Pat. No. 3,952,852, and have no direct bearing on this invention.

In normal operation, each time the operation flag (f) addresses a carrier return code, logic and control 45 will output a carrier return along the carrier return line 27 to printer 2. This operation will continue until the operation flag (f) addresses the first column begin (CB) code and the memory is as illustrated in FIG. 3. At this point the printed page will appear as illustrated in FIG. 4.

LINE SPACE INCREMENT SCAN AND CONTROL

It is to be assumed that the multi-column setup operation defined in U.S. Pat. No. 3,952,852 has been performed. That is, the flag (f) has been advanced and column marker codes have been inserted into memory. The memory will be as illustrated in FIG. 5.

Following insertion of column markers, a line space increment scan is performed. This involves temporarily suspending printout while line space increment control 205 scans the data in the shift register 19.

Figure 18:
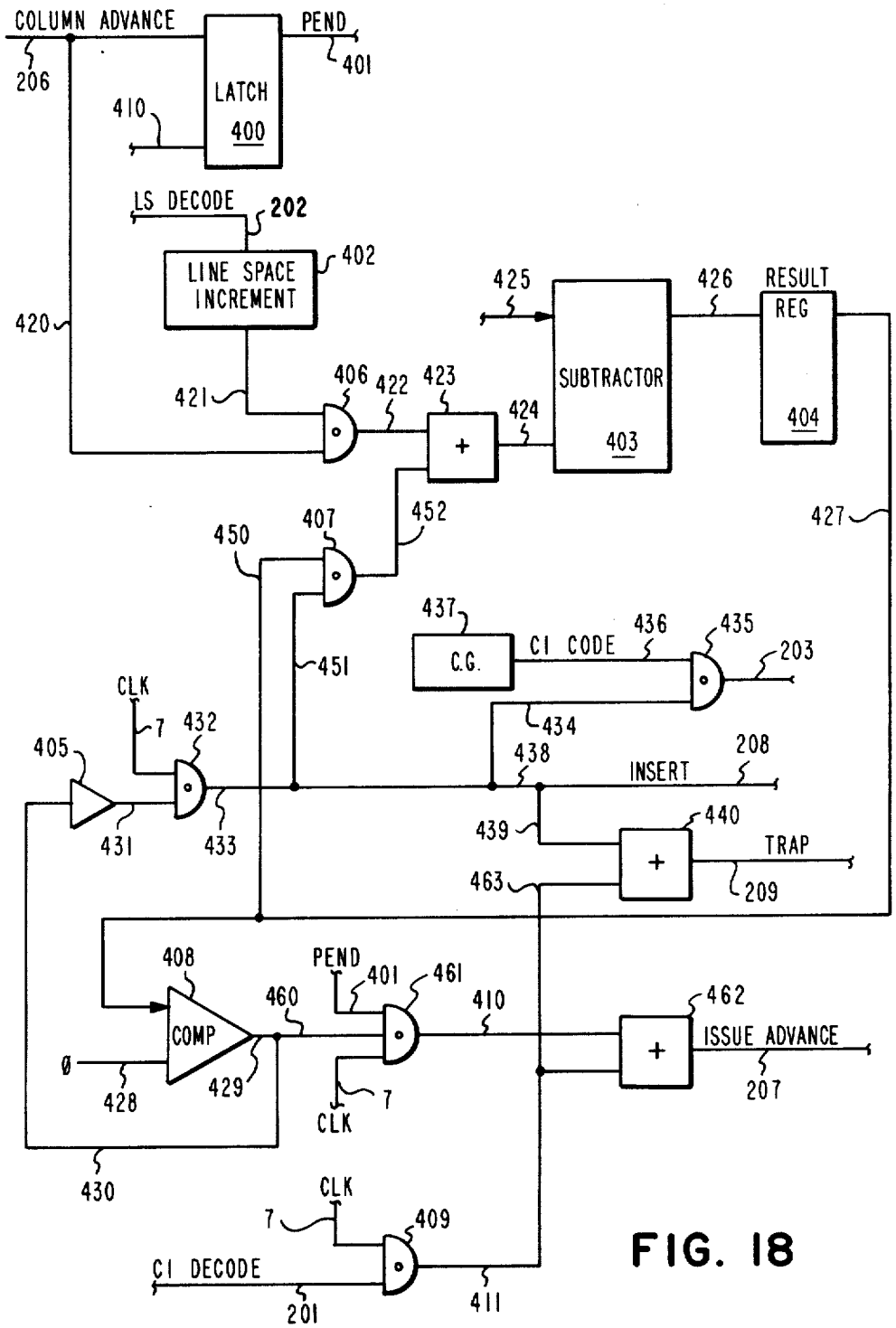
FIG. 18 illustrates the structure included in the line space increment control of FIG. 16.

As pointed out above, data codes in shift register 19 continually circulate and appear on shift register data buss 20. During this circulation, each code is applied along line 22 to decode 44. The outputs of decode 44 are along lines 29, 201, and 202 to line space increment control 205. The scan operation thus involves the monitoring of signals output from decode 44. When a line space increment code (LSX) is applied along line 202 to line space increment control 205, it is stored in an included internal store such as a random access memory or counter 402 (FIG. 18). Each succeeding line space increment code detected will be stored and written over the preceeding line space increment code in the internal store 402. Scanning and updating of the internal register 402 continue until the operation flag (f) is again detected. The codes detected during scanning are used by line space increment control 205 to control insertion of column index (CI) codes into the text and control code memory circulating in shift register 19. Monitoring of lines 29 and 202 continues during printout, and the internal store 402 is updated for each line space increment code detected. This will ensure that the line spacing increment value represented by the line space increment code and stored in the internal store 402 is current. When the scanning operation has been completed, all operations up to a column advance operation will take place.

Refer next to FIG. 18 in conjunction with FIG. 16. FIG. 18 illustrates the structure included in the line space increment control 205 shown in FIG. 16. When the multi-column control logic and playout 45 is ready to perform a column advance operation, a signal is applied along line 206. This causes a pending latch 400 to be set, and a pending signal to be applied along line 401. The signal appearing on line 206 is also applied along line 420 to AND gate 406. The other input to AND gate 406 is the stored line space increment value from line space increment store 402 along line 421. Store 402 is the internal store referred to above. The signal appearing on line 420 causes the current line space increment value stored in store 402 to be applied along line 422 to OR gate 423, and along line 424 to subtractor 403. In subtractor 403 a hardwired "one" applied along line 425 is subtracted from the line space increment value applied from store 402. The resultant value is then applied along line 426 to result register 404. The resultant value stored in register 404 is applied along line 427 to comparator 408 wherein it is compared with a hardwired "zero" input along line 428. If there is a non-compare, a number of operations are called for. First, a column index (CI) code is to be inserted into shift register 19. This is caused by the down (non-compare) output of comparator 408 applied along lines 429 and 430 to inverter 405. The up output of inverter 405 is along 431 to AND gate 432. The other input to AND gate 432 is along the clock line 7. Upon a clock pulse, a signal is then applied along lines 433 and 434 to AND gate 435. The other input to AND gate 435 is a column index (CI) code along line 436 from code generator 437. The column index code is then applied along line 203 to OR gate 15 in FIG. 16 for insertion into shift register 19. The output of AND gate 432 on line 433 is also applied along line 438 and insert line 208 to OR gate 39 in FIG. 16. Further, the signal appearing on lines 433 and 438 is applied along line 439 to OR gate 440. The output of OR gate 440 is along line 209 to OR gate 210 in FIG. 16. This serves as a trap signal for the trap function described earlier. It is to be noted that a trap signal is also generated by logic and control 45 and applied along line 41 to OR gate 210. When a trap signal is applied along line 209, a trap function is called for and the operation flag (f) is to be positioned in front of the column index (CI) code just inserted. This is required to obtain a proper positional relationship between the column index (CI) code and a column marker (CM) code which will be inserted by the multi-column control logic and playout control 45 during a column advance operation. As discussed earlier, the flag (f) is written over with a column marker (CM) code during a column advance operation.

A non-zero value in result register 404 when applied along line 427 will be reduced by one on a following clock time. This controls the number of column index codes written into memory. The value appearing on line 427 is applied along line 450 to AND gate 407. The other input to AND gate 407 is along line 451 from AND gate 432. The output of AND gate 407 is along line 452 to OR gate 423 and along line 424 to subtractor 403. Thus, the value in register 404 is decremented by one. This operation is repeated and column index codes are inserted into memory until the value in the result register 404 is zero. When a zero value is applied along line 427 to comparator 408, and pending latch 400 is set, an issue advance signal is applied along line 207 to multi-column control logic and playout control 45. The up output of comparator 408 along line 429 is also applied along line 460 to AND gate 461. The other inputs to AND gate 461 are a pending signal along line 401 and a clock signal along line 7. The output of AND gate 461 is along line 410 to OR gate 462, and then along issue advance line 207. This causes a column advance operation and escapement of printer carrier 2*a* to take place. The output of AND gate 461 along line 410 is also applied to latch 400 to reset it.

During printout when a column index (CI) code is decoded by decode 44 in FIG. 16, a signal is applied along line 201. This signal is applied to AND gate 409 and upon a clock signal along line 7, a signal is applied to line 411 in FIG. 18. The signal appearing on line 411 is also applied along line 463 to OR gate 440 and a trap output is applied along line 209 to cause deletion of the column index (CI) code from memory. As before, the trap signal appearing on line 209 is applied to OR gate 210 in FIG. 16 and then along line 465 to shift register control 17. An issue advance signal results from the output of AND gate 409 and is applied along line 207 to logic and control 45 to cause a column advance and escapement of printer carrier 2*a*, rather than printing. Playout operations continue until all text intended for side-by-side playout has been printed.

In summary, a system is provided having a keyboard and printer, a text and control code buffer, a multi-column playout control, and a line space increment control. During input keying, line space increment codes are keyed and stored along with text codes in the buffer. This is the case for columns which are to be stored sequentially, but printed out in a side-by-side format with varying line spacing requirements among the columns. When columnar playout begins from the buffer, the first detected line space increment code is stored in a line space code store. Following printing of one line of a column, a column advance operation is performed before printing any corresponding line from the next column on the same print line. During this operation, the text and control code memory in the buffer is updated, if necessary, for the current column. A scan operation accompanies the column advance operation, and if the next column has a different line spacing requirement, the line space code store is updated. That is, during input keying, the line space increment for the column being keyed is stored in the memory. This will control upon later printout the number of effective carrier returns or indexes to be executed by the printer. When the line spacing increment is to change, for example, from single to double indexing, another line space increment code is keyed and stored in the text and control code memory. Upon playout from the memory, the memory is scanned and the first line space increment code is stored in the line space code store. Printing then begins from memory for the first line of the first column. When a carrier return is detected, a number of column index codes are written into memory before the second line of the first column. This number will be equal to the line space increment, minus one. The printer is caused to tab rather than carrier return, and a column advance operation is performed. During the scan operation associated with the column advance operation, the operating point (operation flag) is advanced to the beginning of the second column. If a line space increment code is stored for the second column, the line space code store is updated. Following printout of the first line of the second column, the memory is updated. This is accomplished as before with a number of column index codes being stored in memory before the second line of the second column. Operations continue as described for the first line of each column, and then a column advance operation is performed to the first column. The carrier will have been returned to the left margin to begin printing on the second print line. A detected column index code will result in deletion of the column index code, carrier escapement, and a column advance operation to begin printing the next column. Thus, there is in effect a multiple indexing operation when a column index code is detected in memory.

While the invention has been particularly shown and described with reference to a particular embodiment, it will be understood by those skilled in the art that various changes in form and detail may be made without departing from the spirit and scope of the invention.

What is claimed is:

1. In a system including a buffer having a plurality of text columns sequentially stored therein and line spacing requirements for text making up said text columns stored therein, means for reading said buffer, and means for effecting a side-by-side columnar format through playing out corresponding lines of said text columns on a print line prior to causing a printer carrier return; the improvement comprising:

(a) means for determining said corresponding lines for following text based on reading a line spacing requirement; and (b) means included in said determining means for updating said buffer to effect proper line spacing upon playout from said buffer if a line is not to be played out on a subsequent print line.

2. A system according to claim 1 including a store for storing said line spacing requirement upon reading said line spacing requirement.

3. A system according to claim 2 including means for subtracting a line spacing increment from said line spacing requirement stored in said store to obtain a resultant line spacing requirement.

4. A system according to claim 3 including means for determining if said resultant line spacing requirement is greater than zero.

5. A system according to claim 4 wherein said means for updating said buffer includes means for inserting an index code into said buffer for a subsequent line if said resultant line spacing requirement is greater than zero.

6. A system according to claim 4 wherein said means for updating said buffer includes means for inserting a number of index codes into said buffer for subsequent lines of a column played out until said resultant line spacing requriement is zero.

7. A system according to claim 6 including means for causing an advancing of playout to a corresponding line of a following column after said resultant line spacing requirement is zero.

8. A system according to claim 5 including means for deleting said index code from said buffer when read during playout.

9. A system according to claim 6 including means for deleting one of said index codes from said buffer when read during playout of one of said subsequent lines.

10. In a system including a buffer for storing a plurality of sequentially keyed columns, means for reading said buffer, and means for playing out corresponding lines of said columns on a print line prior to causing a printer carrier return; the improvement comprising:

(a) means for storing said columns and any line spacing requirements therefor in said buffer;

(b) storage means for storing a line spacing requirement upon reading a line spacing requirement from said buffer;

(c) means upon playing out a column line following a line spacing requirement for determining if the following column line is to be played out on the following print line; and (d) means for updating said buffer to inhibit playout of said following line on said following print line if said following line is not to be played out on said following print line.

11. A system according to claim 10 including means for causing an advancing of playout to a corresponding line of a following column after updating said buffer.

12. A system according to claim 11 wherein said advancing means includes means for causing an advancing of playout to a corresponding line of another following column if said buffer has been updated for said following column.

* * * * *